US005311854A

United States Patent [19]

Cullum

[11] Patent Number: 5,311,854

[45] Date of Patent: May 17, 1994

[54] TWO-CYCLE INTERNAL COMBUSTION ENGINE WITH REDUCED UNBURNED HYDROCARBONS IN THE EXHAUST GAS

[75] Inventor: Harry Cullum, East Hampton, N.Y.

[73] Assignee: BRQT Corporation, New York, N.Y.

[21] Appl. No.: 7,937

[22] Filed: Jan. 25, 1993

[51] Int. Cl.[5] ..... F02D 41/14

[52] U.S. Cl. ..... 123/703; 123/65 BA; 123/162; 123/561

[58] Field of Search ..... 123/65 R, 65 B, 65 BA, 123/73 A, 73 B, 73 C, 735, 162, 478, 561, 672, 676, 703

[56] References Cited

U.S. PATENT DOCUMENTS

| | | | |
|---|---|---|---|
| 3,036,563 | 5/1962 | Garcea | 123/561 X |
| 3,349,760 | 10/1967 | Horan | 123/162 |
| 3,640,255 | 2/1972 | Voelz | 123/703 X |
| 3,926,154 | 12/1975 | Williams | 123/703 X |
| 4,399,778 | 9/1983 | Ancheta | 123/65 VB |
| 4,556,030 | 12/1985 | Aono | 123/425 |
| 4,576,126 | 3/1986 | Ancheta | 123/41.38 |
| 4,774,914 | 10/1988 | Ward | 123/162 |
| 4,789,939 | 12/1988 | Hamburg | 123/674 X |
| 4,903,648 | 2/1990 | Lassankse | 123/703 X |
| 4,936,277 | 6/1990 | Deutsch et al. | 123/436 |
| 4,960,097 | 10/1990 | Tachibana et al. | 123/494 |
| 4,984,540 | 1/1991 | Morikawa | 123/73 C |
| 4,995,354 | 2/1991 | Morikawa | 123/68 V |
| 5,080,064 | 1/1992 | Buslepp et al. | 123/674 X |
| 5,226,921 | 7/1993 | Leistritz | 123/703 |

FOREIGN PATENT DOCUMENTS

| | | | |
|---|---|---|---|
| 55218 | 5/1979 | Japan | 123/561 |

OTHER PUBLICATIONS

*Mark's Standard Handbook for Mechanical Engineers,* Eighth Edition published by McGraw Hill Book Company, 1978, pp. 9-78 to 9-115.

Blair, Gordon P., *The Basic Design of Two-Stroke Engines,* published by The Society for Automotive Engineers, Inc. 1990, pp. 299-357.

D. Watry, R. Sawyer, R. Green and B. Cousyn, "The Application of an Air-to-Fuel ratio Sensor to the Investigation of a Two-Stroke Engine", pp. 1-8, SAE Publication No. 910,720.

*Primary Examiner*—Tony M. Argenbright

*Attorney, Agent, or Firm*—Rosen, Dainow & Jacobs

[57] ABSTRACT

A two-cycle internal combustion engine configuration and control strategy in which the unburned hydrocarbon emissions in the exhaust gas are measured by a sensor in the exhaust manifold. The information from the sensor is used to control the outflow of air from a blower mixed with the fuel to vary the total volume of fuel and air to thus reduce unburned hydrocarbons in the exhaust gas.

20 Claims, 2 Drawing Sheets

TWO-CYCLE INTERNAL COMBUSTION ENGINE WITH REDUCED UNBURNED HYDROCARBONS IN THE EXHAUST GAS

FIELD OF THE INVENTION

This invention is in the field of two-cycle internal combustion engines, particularly including the types used for power boats and power tools and where poor fuel efficiency and where high unburned hydrocarbons in the exhaust gas have been common characteristics.

BACKGROUND

The two-stroke engine, also referred to as the two-cycle engine, has long been the power plant of choice for applications where power to weight ratio and mechanical simplicity are critical parameters for the operator. This is evident by their wide spread use as outboard motors, motorcross motorcycle racing engines and as the power plants for small, hand held tools such as chain saws and weed cutters. Although the large power to weight ratio of these engines is a desirable characteristic for automobile power plants, their high unburned hydrocarbon emissions (from short circuited air fuel mixture during the scavenging process) and the attendant fuel economy penalty has precluded their widespread acceptance into these markets.

Typical in these engines is a simple exhaust gas scavenging system established mainly by ports in the cylinder head that are covered and uncovered by movement of the piston. Thus, numerous complicated and expensive seals, valves and related components required in four cycle engines are omitted and not required.

As the CAFE standards for the automobile fleets have increased, the industry has placed even more of a premium on the power to weight ratio of the engine. A small engine of the same power as a larger one lowers the weight of the vehicle and enables designs of smaller frontal area (less wind resistance). Both of these design factors have beneficial effects on fuel economy.

Interest in two-stroke engines is very high in the automotive industry yet the problems of unburned hydrocarbon emissions remains unsolved. Also, legislation on exhaust emission for off-highway vehicles, lawn and garden equipment and marine craft has brought the emission problems of the two-stroke engine to the forefront of those industries. The industries, both recreational and automotive, are anxious for an economical way to control the emissions, in particular the unburned hydrocarbon emissions, and improve the fuel efficiency from two-stroke engines.

Numerous U.S. patents and other publications discuss the operation and characteristics of these engines, examples including U.S. Pat. Nos. 4,995,354; 4,960,097; 4,936,277; 4,903,648; 4,556,030; 4,576,126; 4,399,778; and a description on pages 9–78 through 9–114 from *Marks' Standard Handbook for Mechanical Engineers*, Eighth Edition published by McGraw-Hill Book Company, 1978; and pages 299 through 356 of Chapter 7 of *The Basic Design of Two-Stroke Engines* by Gordon P. Blair, published by The Society of Automotive Engineers, Inc., 1990, all of these references including the complete text of the latter reference being incorporated by reference into this specification. In *Marks'*, for example, on page 9–111 it is stated "in carbureted engines where intake pressure exceeds exhaust (as in two-cycle engines) raw-mixture loss to the exhaust during the valve-overlap period creates very high hydrocarbon emissions. Emissions from two-cycle carbureted engines may be 10 times higher than four-cycle engine emissions."

The massive quantity of unburned hydrocarbons discharged by the exhaust contribute greatly to inefficiency, waste of fuel, and to pollution of the atmosphere, all of these problems being matters of great concern at all levels of society including individual, manufacturer, governmental and international. To some extent these problems have been ignored by continuing the old technology or by choosing alternative power sources with their own inherent disadvantages such as higher cost, higher complexity and lower power-to-weight ratio.

In addressing the above-mentioned problems and operational characteristics in two-cycle engines engineers and mechanics have dealt with a variety of structural components, seeking improvements and solutions. Typical carburetor and throttle devices vary the air/fuel ratio or the rate or directional path of air/fuel flow, or timing, ignition, fuel composition, etc.

A principal focus herein is the high degree of unburned hydrocarbons in the exhaust gas of two-cycle engines due to short circuiting of fuel in the scavenging process. Typically, the carburetor is adjusted to a selected air/fuel ratio, and then the flow of this mixture is throttled by an appropriate valve. In an outboard two-cycle engine the up-stroke of the piston creates a suction which draws in the mixture the flow of which being throttled by partial blockage of flow into the crankcase.

One alternative control technique used in an engine under the commercial name Orbital, is to use fuel injection directly into the cylinder. Inlet air is pumped into the cylinder to scavenge or clean out exhaust gas. Later, as the piston rises and closes the inlet air port, fuel injection follows. In theory this should substantially eliminate unburned fuel from short circuiting since the scavenging air passing through the cylinder head is not carrying the new charge of fuel with it. On the negative side is the added work input of high pressure fuel injection directly into a closed cylinder head, as compared to the Roots blower low pressure air flow (1 to 1½ atmospheres) which carries the fuel into the cylinder via a typical simple and inexpensive carburetor. The air/fuel mixture is varied by varying the high pressure fuel injection within the cylinder after the port is closed. To control such adjustments over a wide range is difficult, costly, and has not been proven satisfactory.

SUMMARY OF THE INVENTION

The present invention refers to a new two-stroke engine system configuration and operation sequence in which a closed loop sensing system monitors unburned fuel in the exhaust manifold during the scavenging process and implements a fuel and air control sequence to reduce or terminate the intake air flow (and included fuel) if and when unburned fuel is detected. By implementing this closed loop system a major weakness of the two-stroke engine, namely large unburned hydrocarbon emissions from short circuiting, can be controlled without having to implement more costly in-cylinder fuel injection.

The new two-cycle internal combustion engine has an air blower providing a low pressure air flow into the cylinder. Preferably this blower is hydraulically driven for fast response independent of piston or crank-shaft speed or operation. The engine includes fuel introduction whereby the air/fuel mixture is established outside the cylinder. More specifically, fuel or a fuel-oil mixture is introduced either upstream of the blower and then carried in the air flow in an amount proportionate to the blower's air flow this air/fuel mixture being the blower's outflow, or the fuel or fuel-oil mixture is introduced downstream of the blower with the fuel flow directed to be correctly proportional to said blower's air flow. The preferred blower is a typical, simple, inexpensive and reliable Roots type blower.

In this new invention power control is by varying the blower's air flow with an attendant proportional change in fuel flow, and with air/fuel ratio being generally maintained unless intentionally varied separately from the above-described variation in air flow.

A sensor monitors the exhaust gas and/or its components and determines the presence of excessive unburned hydrocarbons. The above-mentioned *The Basic Design of Two-Stroke Engines*, on pages 40, 305–316 and elsewhere, describes monitoring the exhaust gas and its components including hydrocarbon oxygen, carbon monoxide and nitrogen oxides emissions. SAE Article No. 910720, mentioned below, further describes exhaust gas emissions and sensors for monitoring and evaluating same. An appropriate signal from the sensor through a control system directs the blower to send more or less air and proportionate amount of fuel into the cylinder's inlet.

Control and adjustment in this new engine is dynamic in that monitoring of the exhaust gas is essentially continuous and nearly instantaneous with a very high speed sensor. Feedback is to the air blower, which is preferably hydraulically controlled and thus has a high speed response. Throttling of the air flow cuts air and fuel at generally the same percent and thus generally maintains a fixed air/fuel ratio, unless and until it is intentionally altered.

In one embodiment of this invention the blower would run essentially continuously with variation in its speed and resultant air flow and associated fuel flow. In an alternate embodiment the blower would be intermittently stopped when the sensor determined excessive unburned hydrocarbons. In either case the sensor's high speed response time would be followed by a relatively fast response in the blower operation due to its hydraulic motor.

As a further optional variation the blower could essentially charge a pressure holding chamber. Such chamber being operable via valves could provide any required air flow in combination with fuel introduction as described earlier. Such air flow and attendant fuel flow could supply a single combustion cylinder or via a manifold could supply a plurality of combustion cylinders.

The invention described herein is a new technique for monitoring the unburned hydrocarbon emissions from the two-stroke engine and using a feedback control scheme to alter the air and fuel flow into the intake system and thus minimize the unburned hydrocarbon emissions from short circuiting. In the operation of such engine the unburned hydrocarbon sensor located in the exhaust is known to exist, for example the Nissan Air Fuel Ratio Sensor (see "The Application of an Air-to-Fuel Ratio Sensor to the Investigation of a Two-Stroke Engine" by D. Watry, R. Sawyer, R. Green and B. Cousyn published in SAE Article No. 910720, pp. 1–8). If during the scavenging process the air fuel sensor detects unburned hydrocarbons in the exhaust manifold, the output voltage of the sensor rapidly changes (response times of approximately 50 msec.) which then triggers the control circuitry for the hydraulic drive system and the fuel and oil flow. This will rapidly reduce or terminate air flow and reduce or terminate short circuiting of the unburned hydrocarbons into the exhaust and out into the atmosphere. In this way the engine dynamically controls the air and fuel flow into the engine.

This design yields an engine of high delivery ratio and good scavenging efficiency, retains the advantages of the high power to weight ratio of the two-stroke engine, and reduces the unburned hydrocarbon emission of a typical two-stroke engine without having to use in-cylinder fuel injection. It is anticipated that this control device and strategy will be most effective under conditions of high loading, the conditions under which the unburned hydrocarbons are the worst. As this system reduces unburned hydrocarbon emissions, engine power may be altered for a variety of reasons, however a principal benefit is removal of a quantity of fuel from the inlet air which fuel was not going to be burned anyway.

In addition to the features described above there is optional installation of the ground electrode into the piston crown instead of being integral to the spark plug. This will attempt to dynamically move, both compress and expand the spark plasma and discharge current to enhance the early flame development.

It is evident from the prior art patents and publications cited in the specification, that vast efforts have been made and vast sums spent trying to solve the hydrocarbon emissions problems in two-cycle engines. As these efforts continue they appear to become more sophisticated, more complicated more expensive and still without the satisfaction of success. The present invention represents an approach that is totally different from the past, remarkably simple and inexpensive, and one that has promise to be successful despite its most unlikeness in view of the vast prior efforts.

DETAIL DESCRIPTION OF THE PREFERRED EMBODIMENTS

In describing these two figures elements common to both will use the same reference numbers as a matter of convenience.

Figure 1:
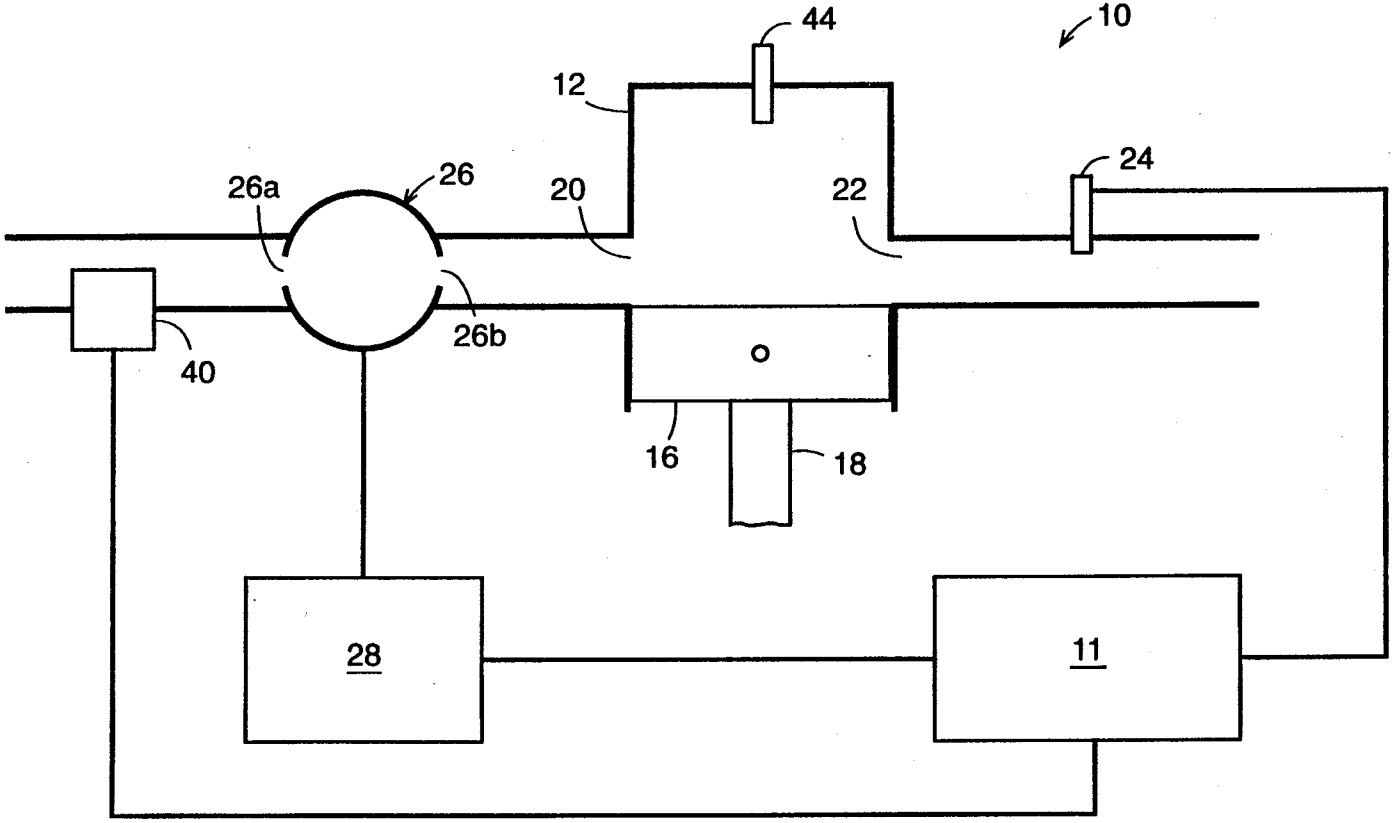
FIG. 1 is a schematic drawing of the new two-cycle internal combustion engine.

In FIG. 1 the new engine 10 is shown in highly simplified schematic form with control system 11, cylinder 12, cylinder head 14, piston 16, piston rod 18, inlet port 20 and exhaust port 22. Downstream of the exhaust port 22 is a sensor 24 for monitoring unburned hydrocarbons in the exhaust gas. Communicating with inlet port 20 is a Roots type air blower 26 driven by hydraulic motor or pump 28 which in turn is powered from the engine drive shaft or other power output. Speed is controlled by the engine's operating logic control system 11, which can achieve rapid slowing of the blower as required.

The sensor 24 which determines excessive unburned hydrocarbons in the exhaust may be, for example, the Nissan Air Fuel ratio sensor as described above. The sensor used was derived from the one developed by Nissan, with a response time between 25 ms and 100 ms and accuracy within 3% in the range of 10–25 A/F using gasoline as the fuel. This article and further references recited on page 7 of this article are incorporated herein by reference.

The Roots blower 26 has inlet 26*a* and outlet 26*b* as shown, the outlet directed to cylinder head inlet 20. Fuel for this engine is introduced via a fuel/oil injector or carburetor 40 upstream of blower 26 and into the air stream of the blower. In contrast to prior art engines which vary fuel, air/fuel ratio, flow of fuel or air/fuel and other parameters, this engine primarily varies air flow driven into the cylinder, with the variation dynamically controlled as a reaction to the exhaust gas sensor.

Figure 2:
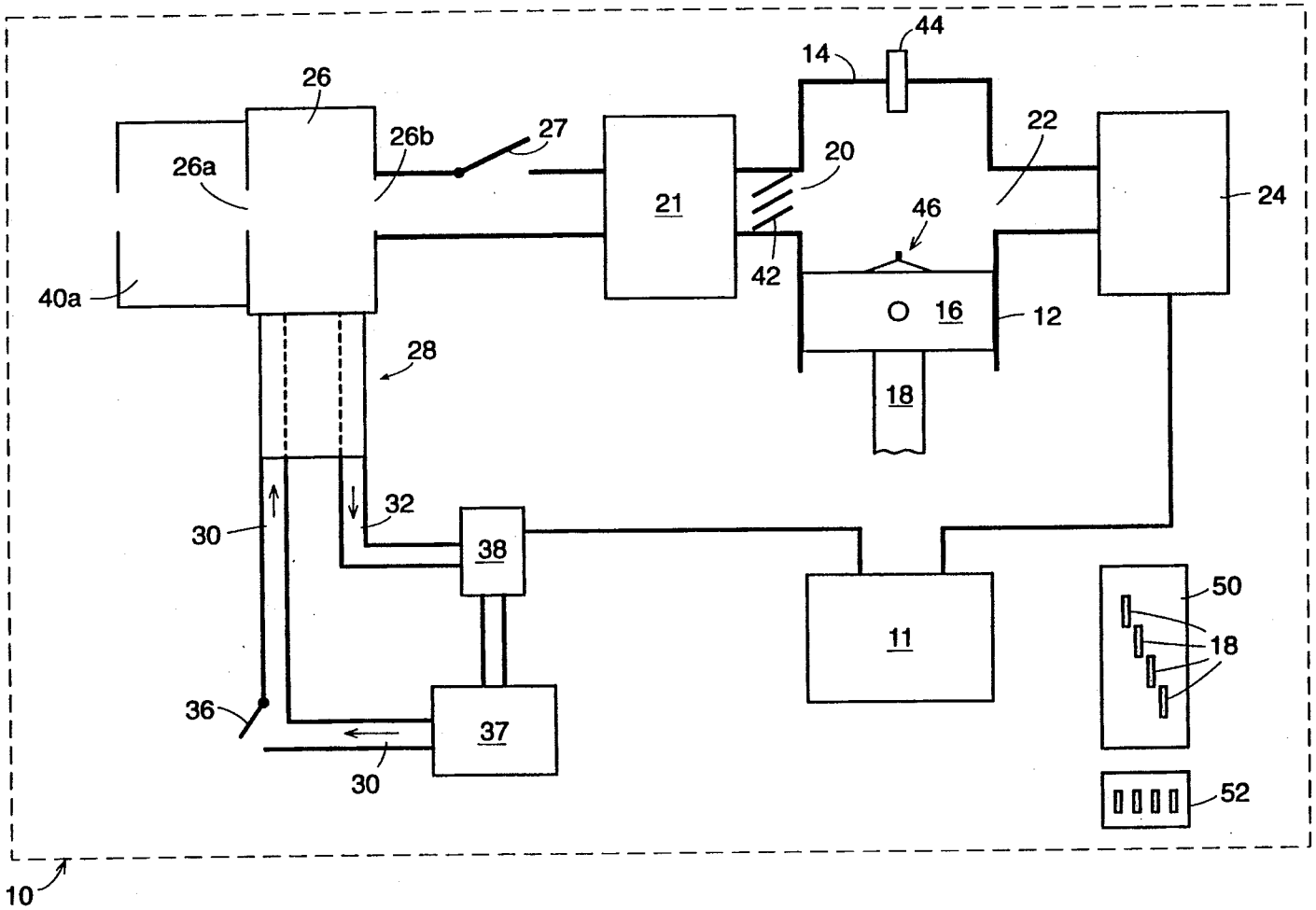
FIG. 2 is a schematic drawing of a variation of the engine of FIG. 1.

FIG. 2 shows the new engine 10 in simplified schematic form generally similar to FIG. 1 but with additions and variations. This engine 10 includes a control system 11, cylinder 12, cylinder head 14, piston 16, piston rod 18, inlet port 20 and exhaust port 22. Downstream of the exhaust port 22 is a sensor 24 for monitoring unburned hydrocarbons in the exhaust gas. Communicating with inlet port 20 is a Roots type air blower 26 driven by hydraulic motor 28 associated with inlet and outlet fluid flow ducts 30 and 32 respectively. Speed is controlled by hydraulic motor controller 37 and associated dump valve 36 of larger diameter than the inflow duct 30 and situated so that fluid tends to flow in a straight line when dumped. Additionally, there is spring loaded valve 38 associated with the oil outflow line set to achieve a quick stop when oil pressure decreases. This will aid a rapid slowing of the blower when directly connected to the hydraulic motor.

The sensor 24 which determines excessive unburned hydrocarbons in the exhaust may be, for example, the Nissan Air Fuel ratio sensor as described above.

The Roots blower 26 has inlet 26*a* and outlet 26*b* as shown, the outlet directed to cylinder head inlet 20. Fuel for this engine is injected into the air box 40*a* upstream of blower 26 and into the air stream of the blower. As an alternate addition there may be an air dump valve 27 provided for quick relief or termination of inlet flow. Where this air flow contains fuel it would be redirected in an appropriately safe manner.

In contrast to prior art engines which vary fuel, air/fuel ratio, flow of fuel or air/fuel and other parameters, this engine primarily varies air flow driven into the cylinder, with the variation dynamically controlled as a reaction to the exhaust gas sensor. To enhance efficiency the air flow from blower 26 passes angled deflectors 42 which serve both to flush the mixture in the proper direction into the cylinder and to aid as a flame arrestor.

As a further refinement a combined plug-coil 44 fires onto electrode insert 46 in the piston head seeking to provide a longer, hotter spark. The piston may also be shaped to improve dispersion of the air/fuel mixture.

The firing timing would be controlled by contacts 48 on timing gear 50 making contact with points 52 which vary position around the circumference of the timing gear similar to that of a conventional distributor. To allow for more rapid changes of speed such as with passing, a hook-up from throttle to valve assembly would be provided, similar to the "passing gear" arrangement currently utilized.

While the preferred embodiments herein of the present invention have been shown and described, it is to be understood that the disclosure is for the purpose of illustration and that various changes and modifications may be made without departing from the scope of the invention as set forth in the appended claims.

I claim:

1. In a two-cycle internal combustion engine operable with a source of fuel and a source of air, the engine including a cylinder with inlet and outlet ports, a piston slidable in the cylinder for opening and closing said ports, and fuel introduction means, the improvement comprising a—sensor means for detecting unburned hydrocarbons in the exhaust gas and providing signal information, b—blower with an outlet for directing its outflow into the cylinder inlet port, said fuel introduction means having an outlet upstream of and directed into said blower, c—drive means driven by said engine and coupled to said blower for varying the the blower outflow, and d—control means for receiving said signal information from said sensor means as to unburned hydrocarbons in the exhaust gas and for controlling the blower outflow into the cylinder to reduce unburned hydrocarbons in the exhaust gas.

2. An engine according to claim 1 wherein said fuel introduction means is a carburetor wherein fuel is drawn by air flow of the blower and the air/fuel ratio established by the carburetor setting is generally maintained when the air flow is reduced.

3. An engine according to claim 1 wherein said control means, upon receiving signal information from said sensor means as to the presence of unburned hydrocarbons in the exhaust gas, causes said blower to reduce the airflow and a proportionate amount of fuel into the cylinder.

4. An engine according to claim 1 wherein said sensor has a response time at least as fast as 100 msec. for detecting and evaluating unburned hydrocarbons.

5. An engine according to claim 1 further comprising a hydraulic pump driven by the engine and coupled to drive said blower.

6. An engine according to claim 1 wherein said control means comprises means for continuously receiving signal information data from said sensor means and continuously sending control signals to said drive means, thus providing dynamic feedback for continuously minimizing unburned hydrocarbons in the exhaust gas under changing operating conditions of said engine.

7. An engine according to claim 1 wherein said blower is a low pressure ratio Roots type air blower.

8. An engine according to claim 1 operable with a spark plug situated in the cylinder head and the piston has a crown top, the engine further comprising a ground electrode situated in said crown, said ground electrode being positioned relative to the spark plug so as to beneficially affect spark plasma and discharge current and enhance early flame development.

9. An engine according to claim 1 wherein said control means adjusts air flow from the blower and fuel flow therewith to optimize power output of the engine relative to the load condition.

10. In a two-cycle internal combustion engine operable with a source of fuel and a source of air received as an air fuel mixture having a predetermined air/fuel ratio, the engine including a cylinder with inlet and outlet ports, a piston slidable in the cylinder for opening and closing said ports, and fuel introduction means, the improvement comprising a—sensor means for detecting unburned hydrocarbons in the exhaust gas and providing signal information, b—a blower with an outlet directed into the cylinder inlet port, c—drive means driven by said engine and coupled to said blower for varying the outlet air flow of the blower, and d—control means for receiving said signal information from said sensor means as to unburned hydrocarbons in the exhaust gas and for controlling the blower air flow and fuel introduction into the cylinder to reduce unburned hydrocarbons in the exhaust gas, with the air/fuel ratio generally maintained when the air flow is reduced.

11. A method of reducing unburned hydrocarbons in the exhaust gas of a two-cycle engine which uses an air blower and fuel introduction by a carburetor operable with air flow of the air blower, comprising:

a—detecting unburned hydrocarbons in the exhaust gas and providing corresponding signal information, b—determining the amount of reduction of air flow and included fuel into the engine cylinder to reduce unburned hydrocarbons in the exhaust gas, and c—providing control means for varying said air flow and included fuel into the engine cylinder according to said determination in step b.

12. A method according to claim 11 wherein the air/fuel ratio is generally maintained while the air/flow is reduced.

13. A method according to claim 12 where the engine is subject to both high and low loading conditions, and wherein the control means reduces unburned hydrocarbons during high loading conditions without appreciably reducing engine power.

14. Method to improve fuel efficiency of a two-cycle engine which uses an air blower and fuel introduction by a carburetor operable with air flow of the air blower, comprising a—detecting unburned hydrocarbons in the exhaust gas and providing corresponding signal information, b—determining the amount of reduction of air flow and included fuel into the engine cylinder to reduce unburned hydrocarbons in the exhaust gas, and c—providing control means for varying said air flow and included fuel into the engine cylinder according to said determination in step b.

15. A method according to claim 14 wherein said air flow and included flow forms a mixture having an air/fuel ratio and wherein said air/fuel ratio is generally maintained while said air flow is reduced.

16. A method according to claim 15 where the engine is subject to both high and low loading conditions, and wherein the control means reduces unburned hydrocarbons during high loading conditions without appreciably reducing engine power.

17. In a two-cycle internal combustion engine operable with a source of fuel and a source of air, the engine including a cylinder with inlet and outlet ports, a piston slidable in the cylinder for opening and closing said ports, and fuel introduction means, the improvement comprising a—sensor means for sensing unburned hydrocarbons in the exhaust gas and providing signal information, b—a blower with an outlet for directing an air flow into the cylinder inlet port, said fuel introduction means having an outlet upstream of and directed into said blower, c—drive means driven by said engine and coupled to said blower for varying the outlet air flow of the blower, and d—control means for receiving said signal information from said sensor means and determining unburned hydrocarbons in the exhaust gas and for controlling the blower air flow into the cylinder to reduce unburned hydrocarbons in the exhaust gas.

18. In a two-cycle internal combustion engine operable with a source of fuel and a source of air, the engine including a cylinder with inlet and outlet ports, a piston slidable in the cylinder for opening and closing said ports, and fuel introduction means, the improvement comprising a—sensor means for sensing unburned hydrocarbons in the exhaust gas and providing signal information, b—a blower with an outlet for directing its outflow into the cylinder inlet port, c—drive means driven by said engine and coupled to said blower for varying the outflow of the blower, and d—control means for receiving said signal information from said sensor means and for controlling the blower air flow and fuel introduction into the cylinder to reduce unburned hydrocarbons in the exhaust gas, with the air/fuel ratio generally maintained when the air flow is reduced.

19. A method of reducing unburned hydrocarbons in the exhaust gas of a two-cycle engine which uses an air introduction means and fuel introduction by a carburetor operable with air flow of the air introduction means for producing an air/fuel mixture to the engine cylinder, comprising:

a—evaluating the exhaust gas for presence of unburned hydrocarbons and providing corresponding signal information, b—determining from said signal information the amount of reduction of air flow and included fuel into the engine cylinder to reduce unburned hydrocarbons in the exhaust gas, and c—providing control means for varying said air flow and included fuel into the engine cylinder according to said determination in step b.

20. A method to improve fuel efficiency of a two-cycle engine which uses an air blower and fuel introduction by a carburetor operable with air flow of the air blower comprising a—evaluating the exhaust gas for presence of unburned hydrocarbons and providing corresponding signal information, b—determining from said signal information the amount of reduction of air flow and included fuel into the engine cylinder to reduce unburned hydrocarbons in the exhaust gas, and c—providing control means for varying said air flow and included fuel into the engine cylinder according to said determination in step b.

* * * * *